US008893917B1

(12) United States Patent
Russell et al.

(10) Patent No.: US 8,893,917 B1
(45) Date of Patent: Nov. 25, 2014

(54) OVERFLOW PAN FOR A WATER HEATER AND METHOD

(75) Inventors: Jeffrey R. Russell, Winston Salem, NC (US); David M. Krawiec, Greensboro, NC (US)

(73) Assignee: Camco Manufacturing, Inc., Greensboro, NC (US)

( * ) Notice: Subject to any disclaimer, the term of this patent is extended or adjusted under 35 U.S.C. 154(b) by 395 days.

(21) Appl. No.: 13/413,727

(22) Filed: Mar. 7, 2012

(51) Int. Cl.
*B65D 1/34* (2006.01)

(52) U.S. Cl.
USPC ..... 220/571; 220/571.1; 220/600; 220/604; 220/605; 220/623; 248/346.01; 248/346.05; 248/346.4; 206/557; 206/562; 206/563; 137/312

(58) Field of Classification Search
CPC ..... B65D 1/34; B65D 2519/00034; B65D 2519/00069; B65D 2519/00268; B65D 2519/00288; B65D 2519/008; B65D 71/70; B65D 81/261; B65D 81/264; F24H 9/0005; F24H 9/06; F24H 9/16; F24H 9/165; F24H 9/2007
USPC ..... 206/203, 503, 505–506, 515, 518, 557, 206/562–563; 220/571, 571.1, 572–573, 220/600, 604–605, 607–608, 610, 623, 628, 220/630, 635, 675; 137/312–313; 122/19.2; 211/126.1; 248/346.01, 346.05, 346.4
See application file for complete search history.

(56) References Cited

U.S. PATENT DOCUMENTS 3,480,178 A * 11/1969 Morgan ..... 206/506
3,894,679 A * 7/1975 Reifers et al. ..... 229/407
4,085,773 A * 4/1978 Tinney ..... 137/571
4,195,746 A * 4/1980 Cottrell ..... 220/4.24
4,442,969 A * 4/1984 Holden ..... 229/407
4,928,841 A * 5/1990 Arthurs ..... 220/516
5,060,819 A * 10/1991 Apps ..... 220/519
5,452,739 A * 9/1995 Mustee et al. ..... 137/312
5,487,487 A * 1/1996 Hammett ..... 220/509
5,645,103 A * 7/1997 Whittaker ..... 137/312
5,660,279 A * 8/1997 Apps et al. ..... 206/503
5,881,762 A * 3/1999 Janesky ..... 137/312
6,016,627 A * 1/2000 Nobile ..... 47/1.1
6,116,266 A * 9/2000 Dickison et al. ..... 137/312
6,401,960 B1 * 6/2002 Hammett ..... 220/516
6,997,207 B2 2/2006 McKesson ..... 137/312
8,100,140 B1 * 1/2012 Cantolino ..... 137/312
D700,568 S * 3/2014 Benedict et al. ..... D12/317
2002/0175103 A1 * 11/2002 Kraxner ..... 206/427
2003/0057114 A1 * 3/2003 Brander ..... 206/204
2004/0118737 A1 * 6/2004 Welsh et al. ..... 206/508
2008/0197091 A1 * 8/2008 Lim et al. ..... 211/126.1
2010/0243661 A1 * 9/2010 Upham ..... 220/571
2012/0211497 A1 * 8/2012 Davidson et al. ..... 220/571

OTHER PUBLICATIONS

One page with three (3) digital pictures of a water heater pan of Camco Manufacturing, Inc. (2002).

* cited by examiner

*Primary Examiner* — Mickey Yu
*Assistant Examiner* — Brijesh V. Patel
(74) *Attorney, Agent, or Firm* — Blake P. Hurt

(57) ABSTRACT

An overflow pan for a water heater utilizing recycled material for cost and material efficiency. The overflow pan includes a bottom, a sidewall with an outlet for water drainage therefrom as is standard, a U-shaped lip and a plurality of ribs spaced therearound. The pan bottom includes an exterior surface having a series of regular hexagon shapes, each comprising a concave web for material reduction while retaining integrity and durability.

14 Claims, 6 Drawing Sheets

OVERFLOW PAN FOR A WATER HEATER AND METHOD

FIELD OF THE INVENTION

The invention herein pertains to overflow pans and particularly pertains to a durable overflow pan for a water heater having a bottom formed of geometrical shapes.

DESCRIPTION OF THE PRIOR ART AND OBJECTIVES OF THE INVENTION

Hot water heaters are oftentimes the scene of water leaks and damage because most heaters are in seldom visited basements or unfinished areas of a building. Small water leaks can go unnoticed for extended periods causing damage to floors, moldings, walls and ceilings. It is therefore preferable to install a drip or overflow pan therebeneath. An example of a conventional water heater pan can be found in U.S. Pat. No. 6,997,207. With the ever changing, and increasingly challenging economy people are looking for ways to be "greener" or more eco-friendly as well as cost-efficient. Various types of overflow pans are commercially available, however these pans often utilize excessive costly material and are expensive to manufacture, sell and purchase.

Thus, in view of the problems and disadvantages associated with prior overflow pans, the present invention was conceived and one of its objectives is to provide an eco-friendly overflow pan for a water heater which is formed from recycled polypropylene.

It is another objective of the present invention to provide a durable overflow plan which is formed with less material for cost efficiency.

It is still another objective of the present invention to provide an overflow pan with a bottom having a planar interior surface and an irregular exterior surface.

It is yet another objective of the present invention to provide a durable overflow pan having a bottom surface with a series of regular hexagon shapes formed thereon.

It is a further objective of the present invention to provide an overflow pan with a round configuration having a sidewall with an outlet therein for water drainage.

It is still a further objective of the present invention to provide an overflow pan with a sidewall having a u-shaped lip with a plurality of ribs for strength and durability.

It is yet a further objective of the present invention to provide a method of forming an eco-friendly, cost efficient overflow pan for a standard water heater.

Various other objectives and advantages of the present invention will become apparent to those skilled in the art as a more detailed description is set forth below.

SUMMARY OF THE INVENTION

The aforesaid and other objectives are realized by providing an overflow pan for a water heater formed from recycled polypropylene. The overflow pan includes a bottom and a sidewall with an outlet for water drainage therefrom as needed. The bottom is formed having a planar interior surface and an exterior surface with a series of regular hexagon shapes, each hexagon shape comprising a concave web. With the bottom so formed a decrease in raw material usage of approximately thirty percent is achieved without decreasing the integrity of the overflow pan while providing a "greener" and more eco-friendly product. The sidewall includes a surrounding lip having a U-shape with a plurality of ribs equally spaced therearound for added durability. Three of the ribs are larger and buttress the lip at approximately 120° increments around the pan while extending downwardly below the lip.

DETAILED DESCRIPTION OF THE PREFERRED EMBODIMENT AND OPERATION OF THE INVENTION

Figure 1:
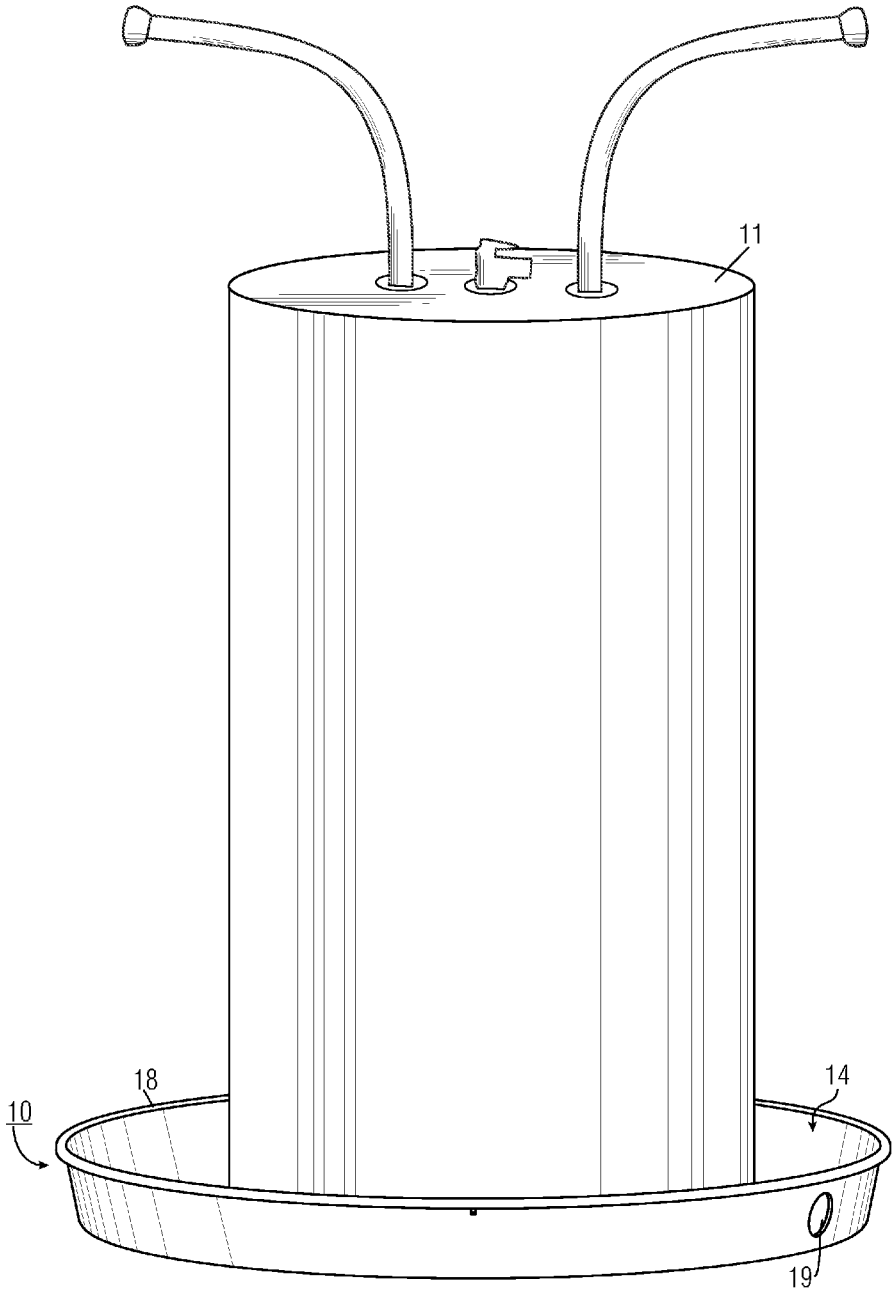
FIG. 1 schematically illustrates a perspective view of the overflow pan of the present invention and a typical water heater thereon.

For a better understanding of the invention and its operation, turning now to the drawings, FIG. 1 schematically illustrates a perspective view of overflow pan 10 for preventing leaking water from escaping conventional water heaters such as standard water heater 11 and causing damage to nearby ceilings, floors, walls, or other nearby articles. In the preferred embodiment, overflow pan 10 includes pan bottom 12 which is injection-molded with planar interior surface 15 and irregular exterior bottom surface 17, made of a honeycombed series of regular concave arcuate hexagon shapes 16. Overflow pan 10 also includes substantially continuous sidewall 14 affixed to pan bottom 12 and further includes U-shaped lip 18 and outlet 19. Overflow pan 10 is preferably formed from recycled polypropylene though certain other plastics such as polyethylene may be used in particular instances, but are not preferred. FIG. 1 also shows the bottom of water heater 11 received into overflow pan 10 which is resting on a floor or other supporting surface (not shown).

Figure 2:
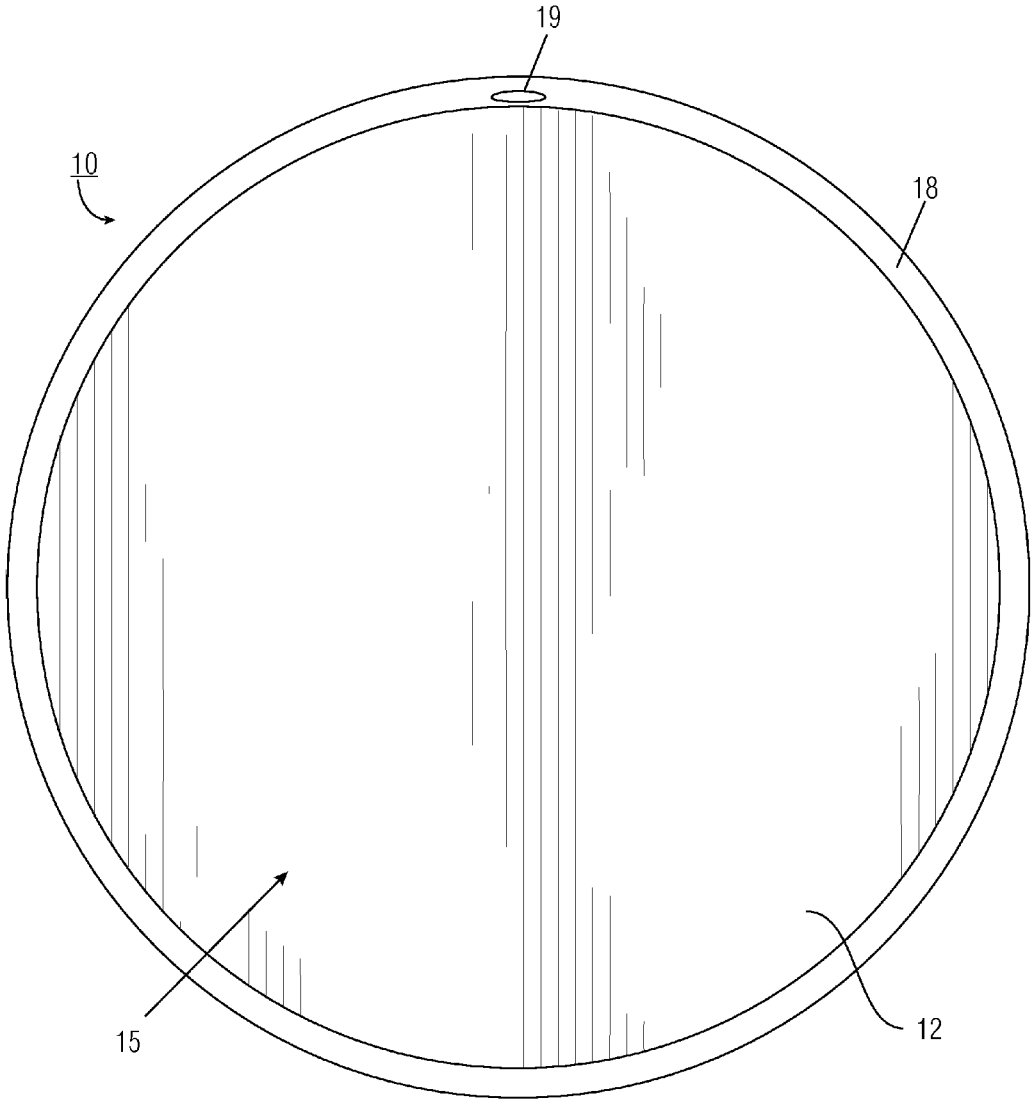
FIG. 2 demonstrates schematically a top interior view of the overflow pan as seen in FIG. 1 removed from the water heater.

FIG. 2 demonstrates schematically a top plan view of overflow pan 10 with standard water heater 11 removed. Overflow pan 10 includes planar interior surface 15 that provides a stable, even surface to support water heater 11. FIG. 2 also shows a generally circular embodiment of preferred overflow pan 10. Overflow pan 10 could likewise be formed in a multitude of shapes such as rectangles or otherwise to correspond to the respective bottom surface of conventional water heater 11. The same can be said of the diameter of overflow pan 10, which is intended to be sufficient to receive the circumference of water heater 11.

Figure 3A:
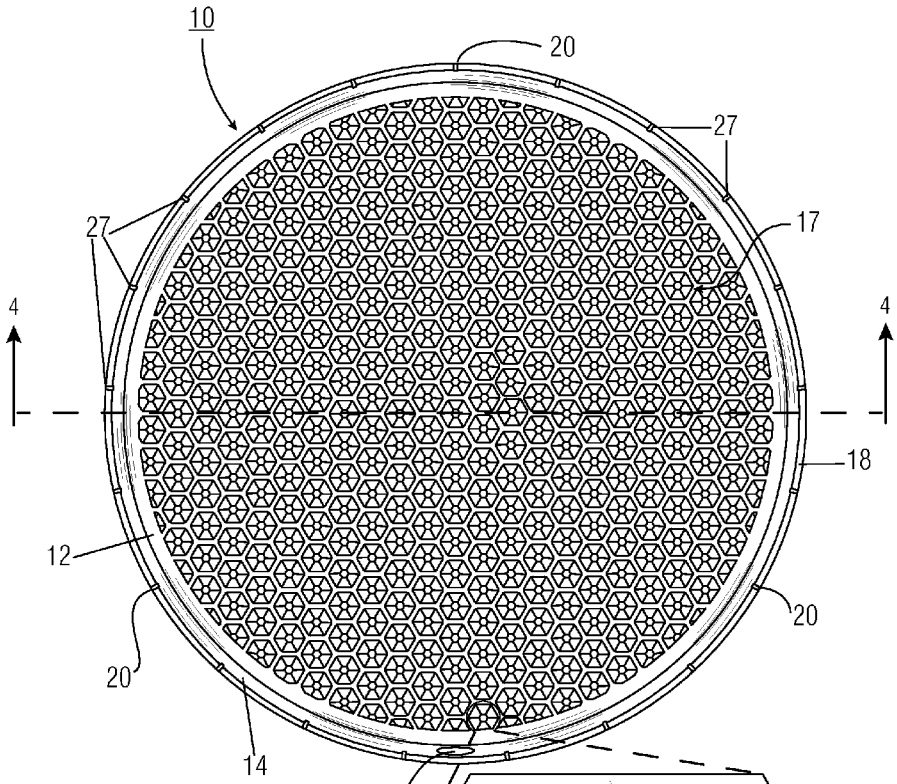
FIG. 3A shows schematically a cross-sectional edge view only of the hexagon and side walls as seen in FIG. 3 along lines 3A-3A.
Figure 3A:
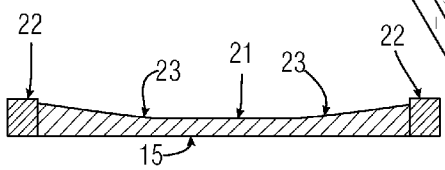
Figure 3:
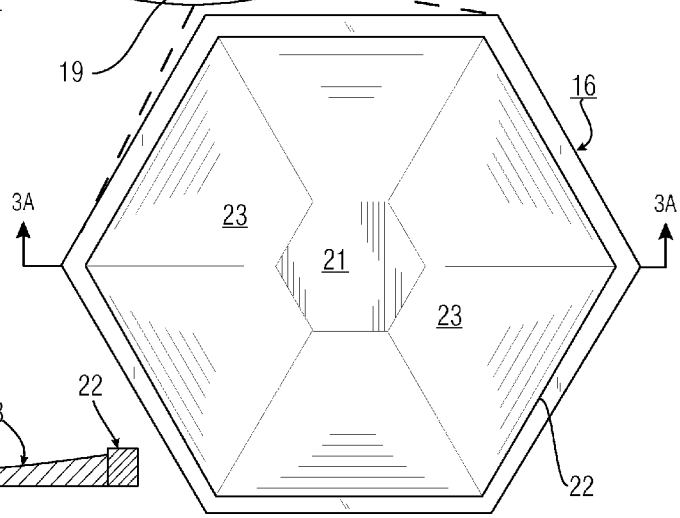
FIG. 3 schematically shows a bottom exterior view of the overflow pan as seen in FIG. 2 and a magnified view of one hexagon shape thereon.

FIG. 3 shows a bottom exterior view of overflow pan 10, a partial magnified view of pan bottom 12, and a further magnified cross-sectional view of hexagon shape 16. Overflow pan 10 as also seen in FIGS. 4, 5, 6 and 7 further includes pan sidewall 14 which is joined both to pan bottom 12 and to U-shaped lip 18. U-shaped lip 18 also includes three (3) large buttress ribs 20 positioned at approximately 120° increments around U-shaped lip 18 in addition to a number of smaller brace ribs 27 as seen in FIG. 3 which provide structural support to the top of overflow pan 10. Without the added support of buttress ribs 20 and brace ribs 27, U-shaped lip 18 would have little structural strength and be susceptible to bending, cracking, or breaking in the event water heater 11 comes in contact therewith.

FIG. 3 also includes an enlarged view of one preferred arcuate hexagon shape 16. Arcuate hexagon shape 16 is made up of six (6) sloped panels 23 which slant down to interior hexagon shape 21, all of which are formed during the injection molding process and combine to make up irregular exterior surface 17 of pan bottom 12. Exterior surface 17 of pan bottom 12 is considered irregular as seen in FIG. 3A due to arcuate hexagon shapes 16 being uniformly distributed in a honeycombed series across pan bottom 12, giving pan bottom 12 a dimpled appearance. The magnified view of arcuate hexagon shape 16 presents smaller, interior hexagon shape 21 and sloped panels 23 which are surrounded by larger, surface hexagon wall 22. This structure allows the planar portions of pan bottom 12 to contact a support surface such as a floor (not shown) with a plurality of surface hexagon walls 22 while reducing the amount of material needed to form overflow pan 10.

FIG. 3A demonstrates a magnified cross-sectional view of arcuate hexagon shape 16. Interior hexagon shape 21 is located on a separate spatial plane than surface hexagon wall 22, requiring sloped panels 23 to connect the two structures. It is sloped panels 23 that provide arcuate hexagon shape 16 with its curved appearance and further allows overflow pan 10 to achieve its material-saving qualities.

Conventional overflow pans generally have a substantially planar exterior bottom surface, as shown in U.S. Pat. No. 6,997,207. However, by forming pans with a planar exterior surface, such pan manufacturers use up to thirty percent more material than is used in overflow pan 10. Although any series of geometric shapes could accomplish the savings in material, regular polygons such as the hexagon are considered preferable for their structural strength in addition to the material savings. A polygon is considered regular if all its internal angles are equal in measure. A hexagon is also considered regular if all the sides have the same length. By forming overflow pan 10 with a series of regular arcuate hexagon shapes 16, manufacturers are able to reduce the overall amount of material used in the formation of overflow pan 10 without jeopardizing structural integrity.

Figure 4:
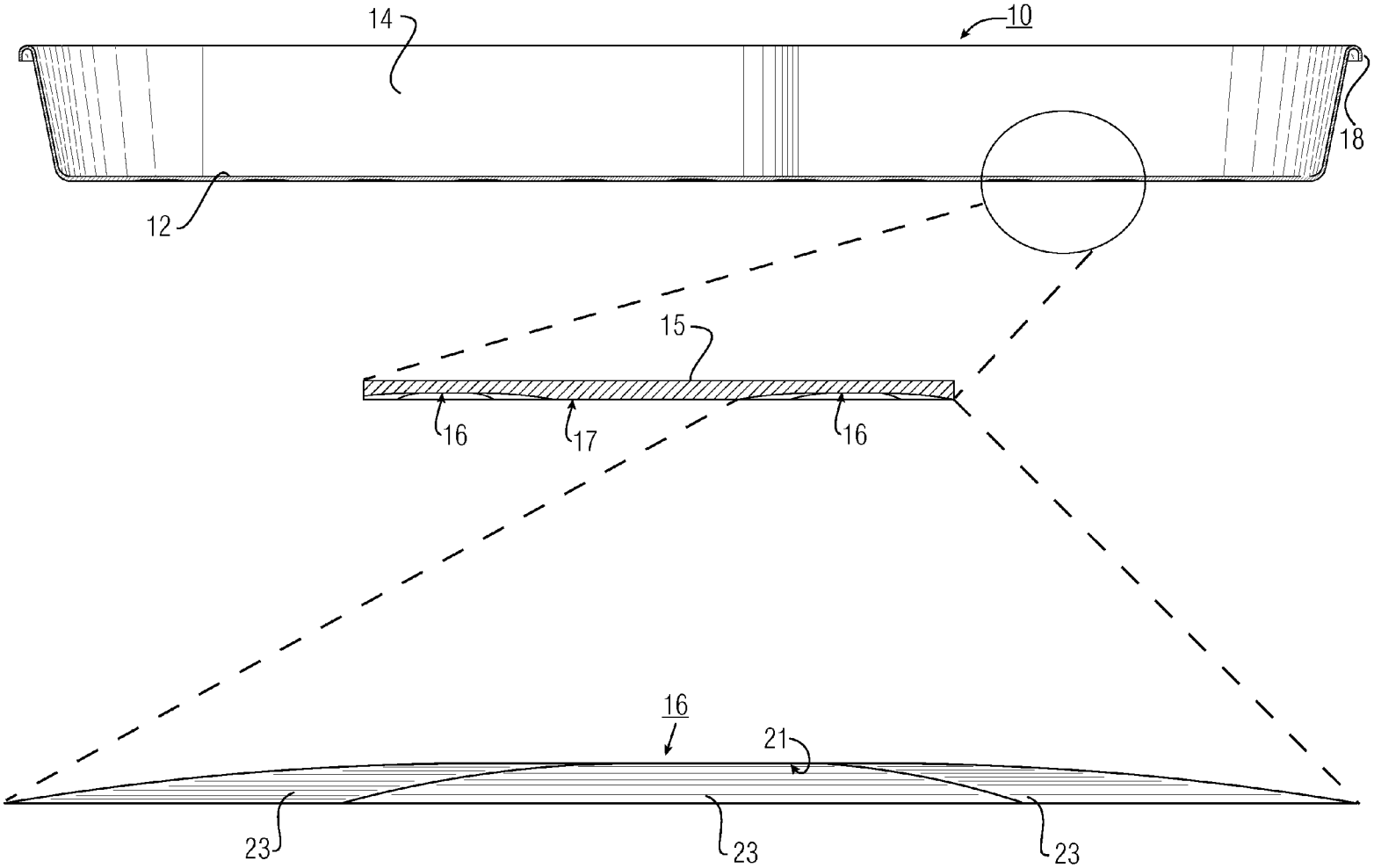
FIG. 4 depicts a cross-sectional view of the overflow pan as shown along lines 4-4 of FIG. 3, a magnified cross-section view of a portion of the pan bottom and a further magnified cross-section view of a hexagon shape.

FIG. 4 depicts schematically an elevated internal cross-sectional side view of overflow pan 10, a magnified cross-section view of pan bottom 12, and a further magnified cross-sectional view of arcuate hexagon shape 16. The concave nature of arcuate hexagon shape 16 as described above and shown in FIG. 3A is shown prominently in FIG. 4, specifically in the magnified cross-sectional views. By molding arcuate hexagon shapes 16 in a concave fashion, manufacturers may save on the cost of materials in the formation of overflow pan 10. FIG. 4 also features U-shaped lip 18, which provides support and strength to the top of overflow pan 10 as well as providing a secure grip on overflow pan 10 in the event that manual relocation of overflow pan 10 is necessary.

Although pan bottom 12 is relatively thin, the amount of material saved due to the formation of arcuate hexagon shapes 16 during molding as a percentage of material overall for pan bottom 12 is substantial. In addition to the material savings and structural strength, arcuate hexagon shapes 16 allow bottom 12 of overflow pan 10 to be more flexible than conventional pans, which is an advantageous feature of overflow pan 10 in the event that the support surface where the pan rests is not perfectly flat.

Further, FIG. 4 also contains a magnified cross-sectional view of arcuate hexagon 16. Sloped panels 23 attach interior hexagon shape 21 to surface hexagon walls 22 and are curved in a manner so as to expand the walls of arcuate hexagon shape 16 from the smaller interior hexagon shape 21 to the larger structure of surface hexagon walls 22.

Figure 5:
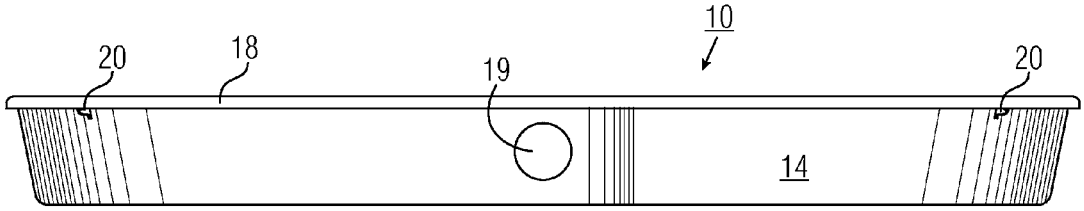
FIG. 5 pictures an elevational front exterior side view of the overflow pan as seen in FIG. 2.

An elevated exterior front view of overflow pan 10 is seen schematically in FIG. 5. In addition to sidewall 14, FIG. 5 also illustrates outlet 19. When water escapes conventional water heaters, the water needs an exit from the overflow pan or it may damage the bottom surface of the water heater or other nearby articles, for example by causing rust. Outlet 19 serves this purpose in the event overflow pan 10 is placed near a drain, or alternatively provides an attachment point for a pipe in the event a user desires to plumb the excess water to a remote location.

Figure 6:
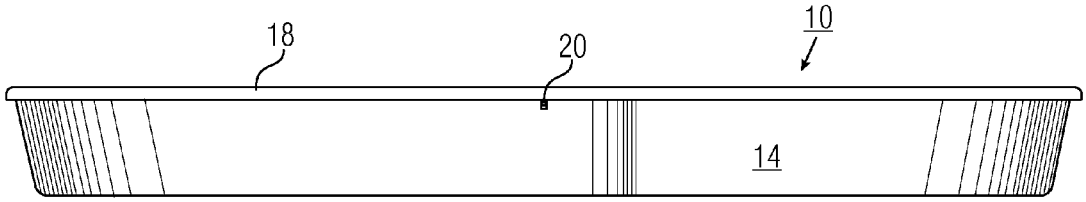
FIG. 6 features an elevational rear exterior side view of the overflow pan as seen in FIG. 5.
Figure 7:
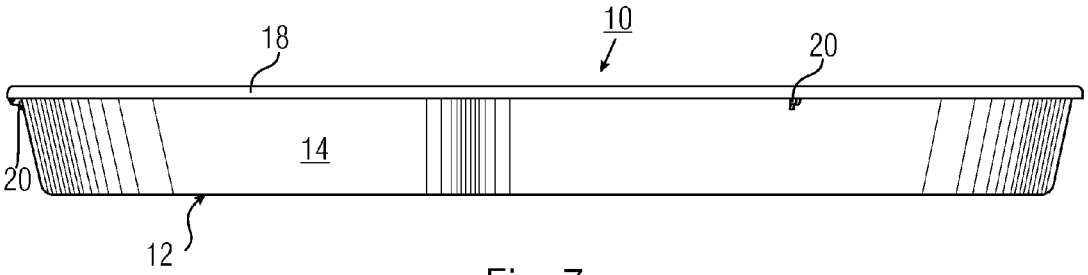
FIG. 7 features an elevational right side exterior view of the overflow pan as seen in FIG. 6, the elevational left side exterior view is a mirror image of this representation.

FIG. 6 features schematically an elevated exterior rear view of overflow pan 10. This view represents the opposite side of overflow pan 10 as shown in FIG. 5. FIG. 7, by way of comparison, demonstrates an elevated exterior right side view of overflow pan 10. The right side view shown in FIG. 7 represents the identical mirror image viewed from the opposite side (not shown).

Figure 8:
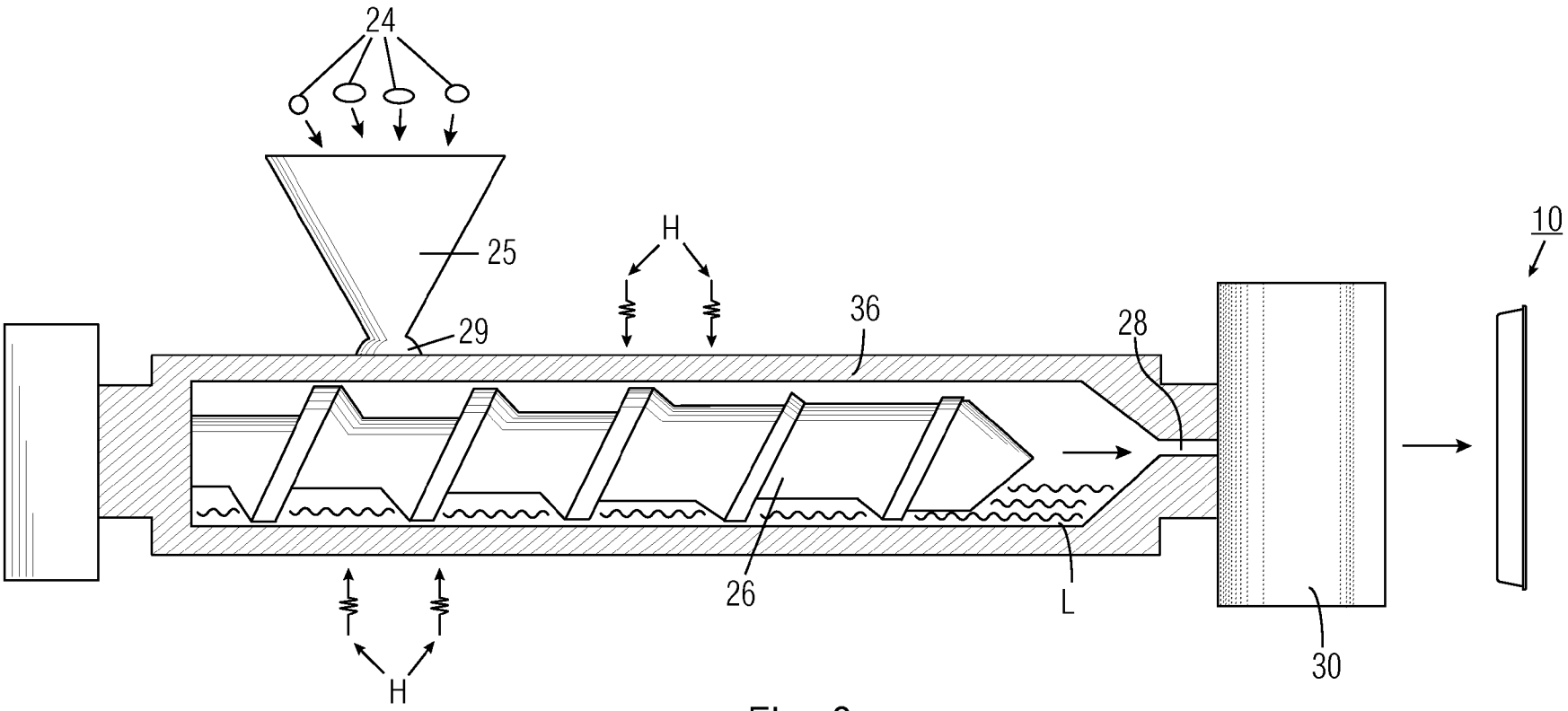
FIG. 8 schematically illustrates a partial cross-sectional view of an injection molding machine, as used in the manufacturing of the overflow pan as seen generally in FIGS. 1-3.

An elevated cross-sectional view schematically illustrates a method for forming overflow pan 10 in FIG. 8. Material to form overflow pan 10, shown here as plastic pellets 24, is introduced into hopper 25 as is customary. Pellets 24 fall through nozzle 29 and into barrel 36 where they form a solid layer and are heated until melted. Heat is illustrated in FIG. 8 with a series of vermiculate lines designated as "H". The liquid material is then driven forward by auger 26, eventually being forced through nozzle 28 and into a cavity (not shown) of mold 30. Liquid is represented in FIG. 8 with the lines designated as "L". The liquid plastic material is forced throughout the cavity of mold 30 and then cooled. Once the plastic material has hardened and the mold has cooled, a clamp (not shown) is opened and fully formed overflow pan 10 is ejected.

In the preferred injection molding process using standard injection molding, thermoplastic recycled polypropylene pellets 24 are poured and contained within hopper 25. Pellets 24 are moved through nozzle 29 of hopper 25 and fall into barrel 36 where they are packed to form a solid bed. Air is then forced out through hopper 25. Other plastics such as polyethylene, polystyrene or the like may also be used but are not preferred. Pellets 24 are then melted utilizing heat H from mechanical shears (not shown) positioned around barrel 36 and moved by auger 26 centrally positioned therein. Auger 26 delivers melted liquid L through nozzle 28 and into a selected cavity (not shown) of mold 30 which is held within a clamp (not shown) for forming overflow pan 10. Once liquid L has filled the cavity, it is allowed to cool and solidifies in mold 30 thus forming injection-molded overflow pan 10. Once cooled the clamp (not shown) is removed, mold 30 is opened and ejection pins (not shown) move forward to eject overflow pan 10 from mold 30 and the process is repeated. The injection pressure is typically 15,000 psi and may range from 3,000-40,000 psi. In the preferred injection molding process it takes approximately 40 seconds from barrel 36 to form a finished overflow pan 10 using a single cavity mold 30.

It is important that the temperature of the melted polypropylene be sufficient to allow the melted plastic under low pressure to completely fill the mold cavity (not shown). In the present invention the plastic is flowed from the center of the pan outwardly to form the pan bottom with honeycomb or webbed hexagon shapes, the sidewall, the u-shaped lip, the buttress ribs and the brace ribs.

The illustrations and examples provided herein are for explanatory purposes and are not intended to limit the scope of the appended claims.

We claim:

1. A pan comprising a bottom with interior and exterior surfaces, a sidewall, said sidewall joined to said bottom, said bottom exterior surface defining a plurality of regular hexagons, each regular hexagon comprising an arcuate web, said arcuate web closing each regular hexagon.

2. The pan of claim 1 molded from plastic.

3. The pan of claim 1 wherein said arcuate web is continuous.

4. The pan of claim 1 wherein said sidewall comprises a U-shaped lip.

5. The pan of claim 4 further comprising a plurality of equally spaced ribs, said plurality of equally spaced ribs joined to said U-shaped lip.

6. The pan of claim 5 wherein one of said plurality of equally spaced ribs comprises a buttress rib.

7. An overflow pan for a water heater comprising: a bottom, a sidewall, said sidewall affixed to said bottom, said bottom defining a planar interior surface and an irregular exterior surface, said irregular exterior surface comprising a series of regular hexagons, each regular hexagons comprising a concave web, said concave web closing each regular hexagon.

8. The overflow pan of claim 7 molded from plastic.

9. The overflow pan of claim 8 formed from polypropylene.

10. The overflow pan of claim 9 comprising recycled polypropylene.

11. The overflow pan of claim 7 wherein said pan has a round shape.

12. The overflow pan of claim 7 wherein said concave web is continuous.

13. A round overflow pan formed from recycled polypropylene for receiving a water heater comprising: a bottom defining a planar interior surface and an irregular exterior surface, a sidewall with a U-shaped lip, said sidewall affixed to said bottom, said sidewall defining an outlet, a plurality of equally spaced buttress ribs, said plurality of equally spaced buttress ribs joined to said U-shaped lip, a plurality of brace ribs, said brace ribs smaller than said buttress ribs and joined to said U-shaped lip, said bottom defining a planar interior surface and an irregular exterior surface, said irregular exterior surface comprising a series of regular hexagons, each regular hexagons comprising a concave web, said concave web closing each regular hexagon.

14. The round overflow pan of claim 13 wherein each of said regular hexagons is formed from a surface hexagon and six sloped panels that are affixed to the surface hexagon and a smaller, interior hexagon.

* * * * *